United States Patent [19]

Gnutzmans

[11] Patent Number: 4,573,164

[45] Date of Patent: Feb. 25, 1986

[54] SUPPORT FOR ELECTRICAL RESISTANCES OF OVENS OR KILNS WITH CERAMIC MANTLE THERMAL INSULATION

[75] Inventor: Ozias A. Gnutzmans, Sao Paulo, Brazil

[73] Assignee: Combustol Industria e Comercio Ltda., Sao Paulo, Brazil

[21] Appl. No.: 702,263

[22] Filed: Feb. 15, 1985

[30] Foreign Application Priority Data

Feb. 16, 1984 [BR] Brazil ..... 6400230[U]

[51] Int. Cl.[4] ..... H05B 3/66

[52] U.S. Cl. ..... 373/130; 174/138 J; 219/532; 219/536; 219/546; 373/134; 338/318

[58] Field of Search ..... 219/390, 406, 532, 536, 219/542, 546, 550, 552; 338/279, 280, 283, 287, 293, 318, 319, 316; 373/111, 128, 130, 133, 134; 174/138 J

[56] References Cited

U.S. PATENT DOCUMENTS

| | | | |
|---|---|---|---|
| 1,622,621 | 3/1927 | Woodson | 373/130 |
| 1,661,842 | 3/1928 | McFarland | 373/130 |
| 1,686,037 | 10/1928 | Schnepf | 373/130 |
| 1,853,382 | 4/1932 | Smalley | 373/130 |
| 1,947,612 | 2/1934 | Moore | 219/532 X |
| 3,705,253 | 12/1972 | Hicks | 219/536 X |
| 3,935,376 | 1/1976 | Cooper et al. | 174/138 J |
| 4,156,792 | 5/1979 | McFadden et al. | 373/130 |
| 4,298,767 | 11/1981 | Takigawa | 373/130 |
| 4,392,052 | 7/1983 | Magnuson | 219/532 |

*Primary Examiner*—Volodymyr Y. Mayewsky
*Attorney, Agent, or Firm*—Kimmel, Crowell & Weaver

[57] ABSTRACT

Utility model patent for a support for electrical resistances of ovens or kilns with ceramic mantle thermal insulation, used to support resistances of the kind consisting of a filament or ribbon of electrical conductor material laid in a sinuous or fretwork fashion on supports and, in this model, comprised of an isosceles-triangular end 1 which is driven into the mantle 2 and followed by a middle flange 3 which is in turn followed by a cylindrical end 4 on which rests the filament or ribbon constituting the resistance 5, the part being completed with a removable ring 8 which is placed on the free end of the end 4 and holds fast on the said end section 4 the portion of ribbon or filament constituting the resistance 5.

1 Claim, 3 Drawing Figures

SUPPORT FOR ELECTRICAL RESISTANCES OF OVENS OR KILNS WITH CERAMIC MANTLE THERMAL INSULATION

The object of this patent is a model of support for electrical resistances of ovens or kilns, which has been given an original configuration with a view to enabling it to be stably mounted on a thermal insulation ceramic mantle of this kind of equipment.

An oven or kiln is generally comprised of a thermally insulated chamber whose interior is heated by electrical resistances or by the burning of a fuel element and in which are placed the parts to be subjected to the heat treatment. The most conventional manner of constructing the thermal insulation layer provides for several layers of refractory bricks cut in such shapes and sizes as to fit the interior of the chamber, laid with refractory mortar, and on which, in the case of ovens heated by electric power, may be mounted the supports for the resistances, which may be of the type consisting of a helicoidal element mounted around a support or of a filament extending sinuously or as in a fretwork ornament and suspended from the respective supports.

The development of ceramic fibers led to a thermal insulation for ovens and kilns in the form of mantles, paper, cloth or rigid plates instead of the usual bricks, affording higher insulation efficiency and considerably reducing the labor required to install the thermal insulation in comparison with the conventional kind.

Despite the efficiency and ease afforded by this new kind of thermal insulation, the mounting of conventional supports for resistances of the sinuously extending or fretwork type causes great difficulties and has proven itself totally inefficient, inasmuch as the mantle has a different structure than the conventional bricks and, therefore, does not sufficiently hold the support, which not rarely falls off, leaving a portion of the resistance unsupported and threatening short circuits or damage to the load of material being treated.

This model of support, developed with this problem in mind and with the goal of overcoming it, essentially comprises a mounting end in the shape of an isosceles triangle, which is buried in the mantle and has a suitable configuration that enables it to be held fast, and a resistance-holding end which extends forward from the mantle and is bounded between a flange which prevents the resistance from coming into direct contact with the mantle and a ring which is applied to its free end and serves to hold fast the resistance even if said resistance is mounted on the ceiling of the oven chamber.

This support construction solves all the problems normally encountered with conventional models and exhibits the further advantage of easy application to the insulating layer and easy installation of the resistance, all this, together with the advantages afforded by the mantle insulating layer, thus contributing to an appreciable improvement in the construction and performance of the oven or kiln.

The annexed drawing depicts the model of support for electrical resistances which is the object of this patent, and includes:

Figure 1:
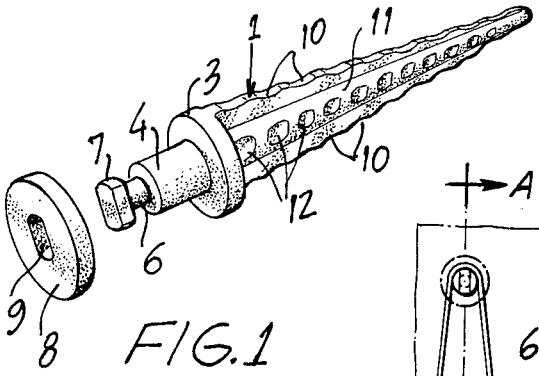
FIG. 1 is a perspective view of the support, its parts being shown separately.
Figure 2:
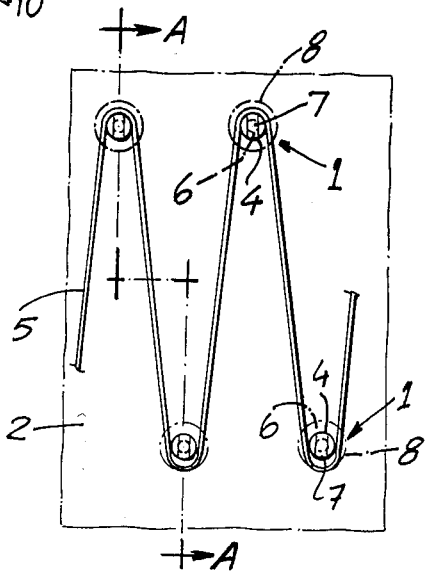
FIG. 2 is an elevation showing the support installed in the insulating layer of an oven and supporting a resistance.
Figure 3:
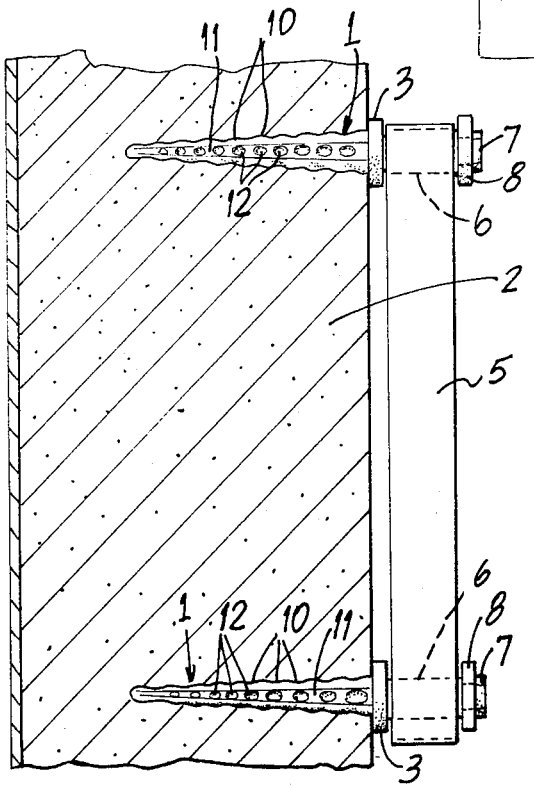
FIG. 3 is a section A—A as shown in the preceding figure.

As shown in the drawings, the model of support for electrical resistances of ovens or kilns which is the object of this application is comprised of a mounting end 1 essentially in the shape of an isosceles triangle, which is buried into the thermal insulating layer 2 of an oven or kiln of the kind consisting of a mantle, paper, cloth or similar material of refractory ceramic fibers, followed by a middle flange 3 which is placed next to the surface of the said thermal insulating layer 2, facing the interior of the oven or kiln chamber, and from which extends a cylindrical end 4 on which rests the filament or ribbon of electrical conductor material constituting the resistance 5, which end 4 is provided near its free end with a surrounding groove 6 followed by a rectangular prismatic head 7 equal in width to the diameter of the said groove 6 and equal in length to the diameter of the end 4, there being provided to complete the assembly a removable ring 8 with a rectangular opening 9 of a size sufficient to pass over the head 7 and which upon being passed over the said head 7, is turned approximately 90° so that it is installed on the grooved portion 6, one side holding the resistance 5 on the end 4 and the other side having the area adjacent to the opening 9 against the head 7.

The mounting end 1 is provided with sinuous edges 10 and centrally and longitudinally on either face with a pronounced rib 11 provided with a series of continuous indentations 12 which give it too a sinuous profile, these constructions being intended to give the end 1 a corrugated shape that promotes its attachment to the thermal insulation layer 2.

The support having these characteristics is constructed from refractory ceramic and exhibits the further advantage that a single kind of shape makes it possible to support the upper or lower face of the ribbon constituting the resistance or to support resistances that are to be installed on the ceiling of the ovens or heated chambers.

What is claimed is:

1. Support for electrical resistances of ovens or kilns with ceramic mantle thermal insulation, used to support electrical resistances of the kind consisting of a filament or ribbon of electrical conductor material laid in a sinuous or fretwork fashion on supports characterized by a mounting end 1 essentially in the shape of an isosceles triangle, which is buried into the thermal insulation layer 2 of an oven or kiln of the kind consisting of a mantle, paper, cloth or similar material of refractory ceramic fibers, followed by a middle flange 3 which is placed next to the surface of the said thermal insulating layer 2, facing the interior of the oven or kiln chamber, and from which there extends a cylindrical end 4 on which rests the filament or ribbon of electrical conductor material constituting the resistance 5, which end 4 is provided near its free end with a surrounding annular groove followed by a rectangular prismatic head 7 equal in width to the diameter of the said grooved portion and equal in length to the diameter of the end 4, there being provided to complete the assembly a removable ring 8 with a rectangular opening 9 of a size sufficient to pass over the head 7 and which upon being passed over the head 7 is turned approximately 90° so that it is installed on the grooved portion 6, one side holding the resistance 5 on the end 4 and the other side having the area adjacent to the opening 9 against the head 7, and by the fact that the mounting end 1 is provided with sinuous edges 10 and centrally and longitudinally on either face with a pronounced rib 11 provided with a series of continuous indentations 12 which give it too a sinuous profile.

* * * * *